US005189436A

United States Patent [19]

Yoshikawa

[11] Patent Number: 5,189,436

[45] Date of Patent: Feb. 23, 1993

[54] RECORDING METHOD THAT SELECTS A MOVEMENT VELOCITY IN CONFORMITY WITH A RECOGNIZED RECORDING WIDTH TO ACCOMPLISH RECORDING AND RECORDING APPARATUS USING THE SAME METHOD

[75] Inventor: Junichi Yoshikawa, Yokohama, Japan

[73] Assignee: Canon Kabushiki Kaisha, Tokyo, Japan

[21] Appl. No.: 501,246

[22] Filed: Mar. 29, 1990

[30] Foreign Application Priority Data

Mar. 29, 1989 [JP] Japan ..... 1-74893

[51] Int. Cl.[5] ..... B41J 2/05; B41J 19/00

[52] U.S. Cl. ..... 346/1.1; 346/140 R; 346/139 R; 400/322

[58] Field of Search ..... 346/139 R, 140, 1.1, 346/140 R; 400/320, 322, 121, 124, 126

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,050 | 7/1984 | Goldberg et al. | 400/124 |
| 4,459,600 | 7/1984 | Sato et al. | 346/140 R |
| 4,463,359 | 7/1984 | Ayata et al. | 346/140 |
| 4,469,460 | 9/1984 | Hughes et al. | 400/322 |
| 4,558,333 | 12/1985 | Sugitani et al. | 346/140 R |
| 4,719,477 | 1/1988 | Hess | 346/140 R |
| 4,723,129 | 2/1988 | Endo et al. | 346/1.1 |
| 4,740,796 | 4/1988 | Endo et al. | 346/1.1 |

FOREIGN PATENT DOCUMENTS

| | | |
|---|---|---|
| 54-56847 | 5/1979 | Japan . |
| 54-150925 | 11/1979 | Japan . |
| 59-123670 | 7/1984 | Japan . |
| 59-138461 | 8/1984 | Japan . |
| 60-71260 | 4/1985 | Japan . |

OTHER PUBLICATIONS

Patent Abstracts of Japan, Unexamined Applications, M Field, vol. 12, No. 109 (M-682) [2956], The Patent Office Japanese Government, Apr. 8, 1988, Abstract of Japanese Patent No. 62-238775.

Patent Abstracts of Japan, Unexamined Applications, M Field, vol. 12, No. 87 (M-678) [2934], The Patent Office Japanese Government, Mar. 19, 1988, Abstract of Japanese Patent No. 62-227674.

Patent Abstracts of Japan, Unexamined Applications, M Field, vol. 12, No. 424 (M-761) [3271], The Patent Office Japanese Government, Nov. 10, 1988, Abstract of Japanese Patent No. 63-158279.

*Primary Examiner*—Joseph W. Hartary
*Assistant Examiner*—Alrick Bobb
*Attorney, Agent, or Firm*—Fitzpatrick, Cella, Harper & Scinto

[57] ABSTRACT

A recording method and apparatus for effecting recording on a recording medium includes elements and steps which recognize a recording width over which recording is to be effected and effecting recording on a recording medium at a movement velocity selected in conformity with the recognized recording width by first accelerating a recording unit along the conveyance path of the recording medium, then moving the recording unit along the conveyance path with a uniform velocity and then decelerating the recording unit, and by effecting recording when the recording unit moves at a constant velocity and when the recording unit is accelerating or decelerating.

26 Claims, 6 Drawing Sheets

RECORDING METHOD THAT SELECTS A MOVEMENT VELOCITY IN CONFORMITY WITH A RECOGNIZED RECORDING WIDTH TO ACCOMPLISH RECORDING AND RECORDING APPARATUS USING THE SAME METHOD

BACKGROUND OF THE INVENTION

1. Field of the Invention

This invention relates to a recording method of effecting recording on a recording medium and a recording apparatus using the recording method.

The recording apparatus using the recording method of the present invention covers the forms, for example, of a printer used as the image output end of an information processing instrument such as a computer, a copying apparatus combined with a reader or the like, a Japanese word processor having a key input function, an electronic typewriter, a facsimile apparatus having transmitting and receiving functions, etc.

Also, the present invention is to conventional recording systems such as, for example, a thermal recording system, the ink jet recording system, and further an impact recording systems such as the daisy wheel recording system and a wire dot recording system.

2. Related Background Art

Recording apparatuses which effect recording by moving a recording unit relative to a recording surface on which recording is to be effected include thermal printers, ink jet printers, wire dot printers, etc., and in these apparatuses, a carrier carrying the recording unit thereon is accelerated to a predetermined velocity in the direction of line, whereafter recording is started and after the termination of recording, the velocity of the carrier is decelerated and the carrier is stopped.

Now, recently there are requirements for higher recording speeds and for this purpose, the velocity of the carrier must be increased.

However, according to the prior-art method, the so-called non-recording section (the approach run section and the stop section) required for the acceleration or deceleration of the carrier in which recording cannot be effected increases greatly. On the other hand, an attempt to shorten the approach run section of the carrier leads to the necessity of making a driving motor for the carrier bulky.

SUMMARY OF THE INVENTION

It is an object of the present invention to provide a recording method and a recording apparatus which can accomplish higher-speed recording.

It is another object of the present invention to provide a recording method and a recording apparatus which can accomplish recording of improved quality.

It is still another object of the present invention to provide a recording method and a recording apparatus which can decrease the non-recording section in which recording means is moved along a recording medium without effecting recording.

It is yet still another object of the present invention to eliminate the above-noted problem peculiar to the prior art and to provide a recording method and a recording apparatus which can accomplish high-speed recording without the non-recording section being increased.

It is a further object of the present invention to provide a recording apparatus in which a recording unit is moved relative to a recording surface to thereby effect recording and which is provided with moving means for moving said recording unit in accordance with a predetermined velocity sequence, and recording means for effecting recording at a dot timing conforming to the velocity sequence of said moving means.

DESCRIPTION OF THE PREFERRED EMBODIMENTS

Embodiments of the present invention will hereinafter be described in detail with reference to the accompanying drawings.

In an embodiment which will be described below, moving means moves a recording unit in accordance with a speed sequence, for example, of constant acceleration, constant high-velocity movement and constant deceleration. On the other hand, recording means effects recording at each dot timing conforming to the velocity sequence of constant acceleration, constant high-velocity movement and constant deceleration by the moving means.

Preferably, the velocity sequence (particularly the highest velocity) differs depending on the recording width of the line being recorded.

Also preferably, the gradient of the acceleration or the deceleration of the velocity sequence is the same.

Figure 4A:
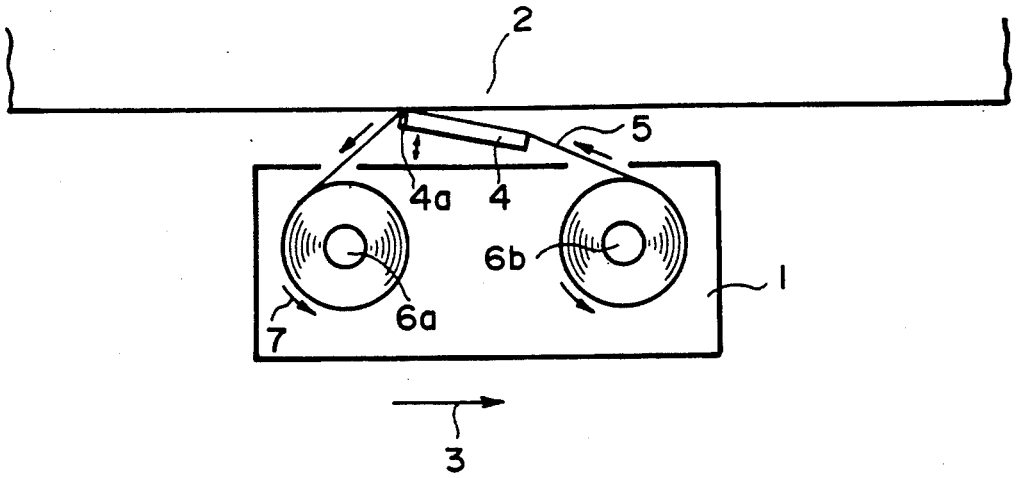
FIG. 4A is a conceptional view of the recording unit of the thermal printer according to said embodiment.
Figure 4B:
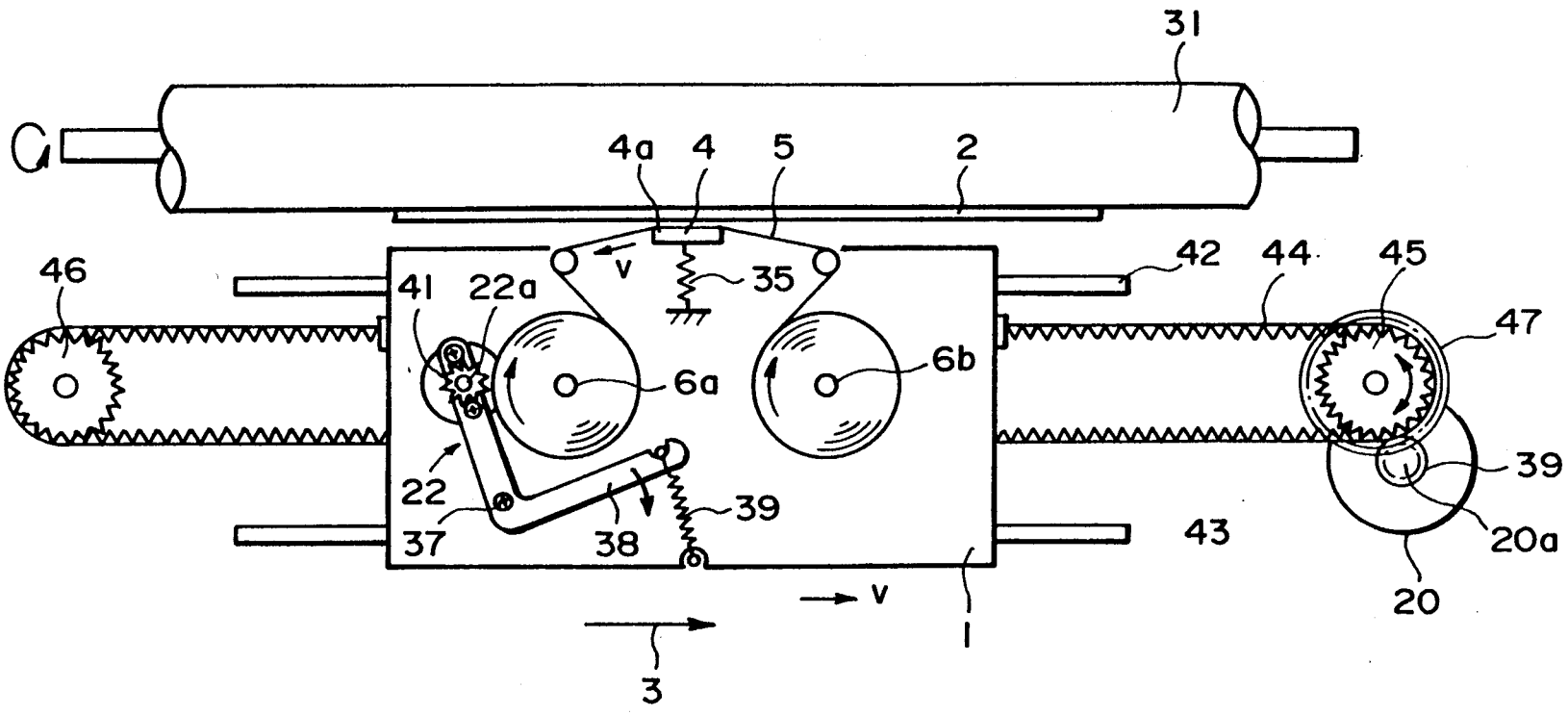
FIG. 4B is a plan view of said thermal printer.

FIG. 4A is a conceptional view of the recording unit of a thermal printer to which an embodiment of the present invention is applied, and FIG. 4B is a plan view of the thermal printer. (Although in FIG. 4B, the recording unit also is shown in greater detail than in FIG. 4A, it is functionally similar.) By a carrier motor 20 being rotatively controlled in accordance with a predetermined velocity sequence, a carrier 1 carrying a thermal head 4 thereon is subjected to constant acceleration, constant high-velocity movement and constant deceleration in the direction of arrow 3. One of the plurality of heat generating elements **4*a* of the thermal head 4 which is selected in conformity with recording information is caused to generate heat at a timing conforming to the velocity of the carrier at each point of time, whereby the ink of an ink ribbon 5 is transferred to recording paper 2 to thereby accomplish recording on the recording paper 2**.

On the other hand, the constant acceleration, constant high-velocity movement and constant deceleration of a take-up reel (a ribbon pan cake) **6*a* in the direction of arrow 7 are also adjusted in operative association with the constant acceleration, constant high-velocity movement and constant deceleration of the carrier 1, whereby the occurrence of the friction between the ink ribbon (thermal ribbon) 5 and the recording paper 2** is prevented.

The thermal printer to which an embodiment of the present invention is applied will hereinafter be described in greater detail with reference to FIG. 4B.

In FIG. 4B, the reference numeral 31 designates a platen formed of a rubber material. The thermal head 4 is pressed against the platen 31 by the spring force of a spring 35 with the ink ribbon 5 and the recording paper 2 interposed between the thermal head and the platen 31. The ink ribbon 5 is disposed on the carrier 1 and is wound from a supply reel **6*b* onto a take-up reel 6*a* through the thermal head 4 on the carrier 1. On one end of a lever 38 rotatable with a shaft 37 on the carrier 1 as a fulcrum, a spring 39 is hooked between the one end and the carrier 1, and rotates the lever 38 clockwise about the shaft 37. A pulse motor 22 for the ribbon is mounted on the other end of the lever 38. A ratchet wheel 41 is secured on the shaft 22*a* of this motor, and the ratchet wheel 41 and the ink ribbon 5 wound on the take-up reel 6*a* are disposed at such positions that due to the tension of the lever 38 by the spring 39, they are stationary in meshing engagement with each other and always bear against each other independently of the turn diameter of the ink ribbon 5. Now, the carrier 1 is mounted on fixed shafts 42 and 43 parallel to the platen 31 and moves the thermal head 4 in parallel to the platen 31. A toothed belt 44 having one end thereof secured to the carrier 1 has the other end thereof also secured to the carrier 1 through pulleys 45 and 46. Further, a gear 47 is constructed integrally with the pulley 45 and is in engagement with a gear 39 secured to the shaft 20*a* of a pulse motor 20 for the carrier. So, the toothed belt 44 can be driven by the rotation of the pulse motor 20 to thereby move the carrier 1 to the left and right in parallelism to the platen 31. The design is made such that the movement velocity v of this carrier and the movement velocity of the ink ribbon 5 driven by the pulse motor 22 for the ribbon become equal to each other in just opposite directions and even if the carrier 1 is moved, the same positions of the ink ribbon 5 and the recording paper 2** will always contact each other.

Figure 1:
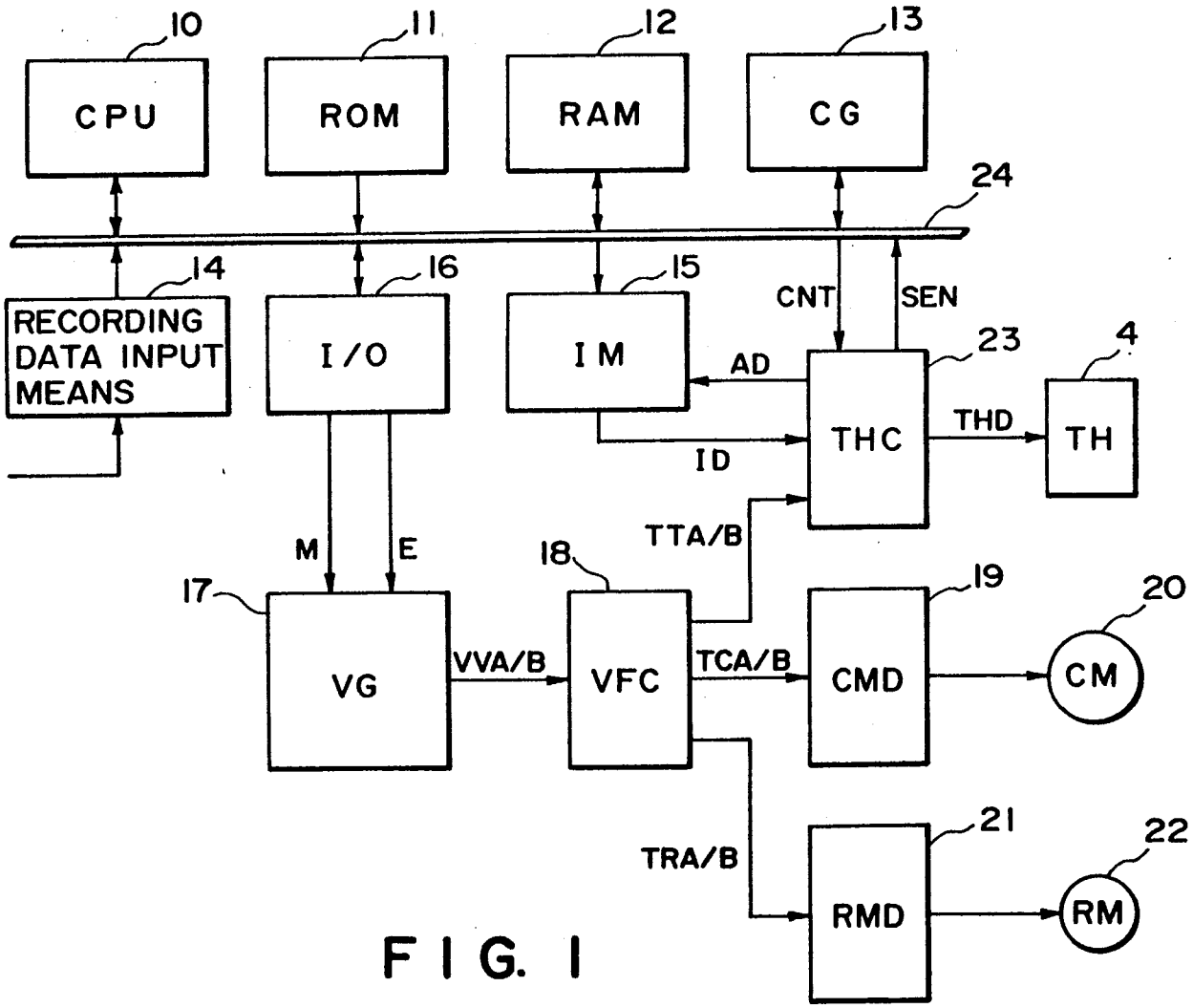
FIG. 1 is a block diagram of the control unit of a block diagram of the control unit of a thermal printer as a recording apparatus to which an embodiment of the present invention is applied.

Now, FIG. 1 is a block diagram of the control unit of the thermal printer according to the aforedescribed embodiment. In FIG. 1, the reference numeral 10 designates a CPU which effects the main control of the thermal printer. The reference numeral 11 denotes an ROM storing therein, for example, the recording control program of FIG. 3 which is executed by the CPU 10. The reference numeral 12 designates an RAM which stores therein a character code for recording and in addition, is used, for example, as a work area by the CPU 10. The reference numeral 13 denotes a character generator (CG) storing therein dot pattern data corresponding to the character code. The reference numeral 14 designates recording data input means for inputting recording data from a host system or a keyboard, not shown. The reference numeral 15 denotes an image memory (IM) which stores therein the dot pattern image of a recorded line developed by the CPU 10. The reference numeral 16 designates an I/0 port (I/0) which decodes the command of the CPU 10 and outputs it. The reference numeral 17 denotes velocity sequence generating means (VG) which outputs the voltage signal VVA/VVB of a different velocity sequence in conformity with the velocity sequence designating mode M from the CPU 10. The reference numeral 18 designates voltage frequency converting means (VFC) which outputs a pulse signal train TCA/TCB of frequency conforming to the velocity sequence voltage signal VVA/VVB. The reference numeral 19 denotes a carrier motor control circuit (CMD) which outputs a phase clock signal for driving a carrier motor (CM) 20 in accordance with a pulse signal TCA/TCB. The carrier motor (CM) 20 is, for example, a pulse motor. The reference numeral 21 designates a ribbon motor control circuit (RMD) which outputs a phase signal for driving a ribbon motor (RM) in accordance with a pulse signal TRA/TRB associated with the pulse signal TCA/TCB. The reference numeral 23 denotes a thermal recording control circuit (THC) which reads out recording data (ID) from the IM 15 in accordance with a pulse signal TTA/TTB also associated with the pulse signal TCA/TCB and drives a thermal head (TH) 4 for heat generation by the ID.

Figure 2:
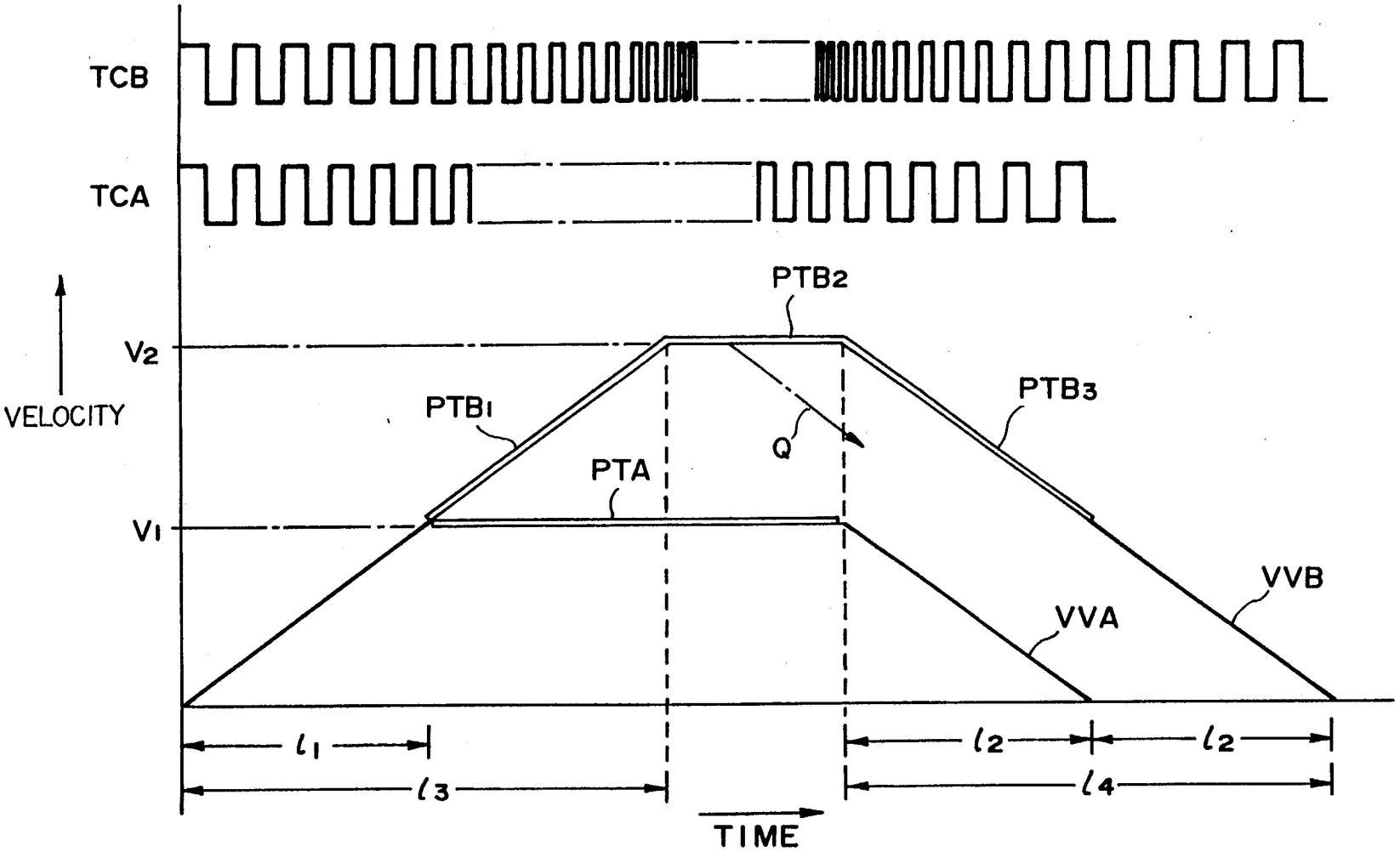
FIG. 2 illustrates the recording control in said embodiment.

FIG. 2 illustrates the recording control of the aforedescribed embodiment. The abcissa represents the time from after the start of the movement of the carrier, and the ordinate represents the carrier velocity. In FIG. 2, graph VVA shows one velocity sequence, and corresponds to the carrier driving pulse signal TCA. According to the graph VVA, the carrier is first accelerated to a velocity $V_1$ at a predetermined acceleration, and is constantly moved at the velocity $V_1$, and thereafter is decelerated at a predetermined rate. The thick line portion in the graph VVA is a portion which actually effects recording (thermal heating), and starts recording after the acceleration to the velocity $V_1$, and starts deceleration after the termination of recording. The velocity $V_1$ is, for example, of the order of 30 characters/sec. as in the prior art, and the carrier extracts the maximum torque characteristic of the carrier motor 20 from the start of driving and rises to the velocity $V_1$. The approach run distance (the non-recording distance) $l_1$ in this case is a practical distance and is relatively short (of the order of 3–5 mm) as in the prior art. This also holds true of the stop distance (the non-recording distance) $l_2$, Graph VVB shows another velocity sequence and corresponds to the carrier driving pulse signal TCB. According to the graph VVB, the carrier is accelerated to a different velocity $V_2$ at the same predetermined acceleration as that previously mentioned, and is constantly moved at the velocity $V_2$, and thereafter is decelerated at the same predetermined rate as that previously mentioned. The velocity $V_2$ is, for example, four to five times the velocity $V_1$ (in the figure, it is shown as twice). Accordingly, the acceleration section needs to exceed the velocity $V_1$ and further reach the velocity $V_2$. Therefore, the approach run distance $l_3$ from the start of driving to the reach to the velocity $V_2$ and the stop distance $l_4$ from the velocity $V_2$ to the stoppage also increase approximately four to five times, but in the present embodiment, recording is started in the vicinity of the velocity $V_1$ in the course of acceleration and recording is continued in the section $PTB_1$ to the velocity $V_2$, and recording is also continued in the section $PTB_2$ of the velocity $V_2$ and recording is possible up to the section $PTB_3$ in the course of deceleration. Accordingly, again in this case, the actual non-recording distance is $l_1$ and $l_2$ as in the prior art. Whether recording should be effected in the course of acceleration and in the course of deceleration can be suitably selected, and for example, recording may be effected in one of the course of acceleration and the course of deceleration and during constant velocity movement. Also, in the present embodiment, as shown by the graph VVA and the graph VVB, the length of the non-recording section during the movement of the carrier 1 in which recording is not effected is made constant irrespective of the highest velocity during recording. As a results the quality of recording can be more improved, greatly and the length of the nonrecording section can be made different.

As described above, according to the present embodiment, when a short sentence is to be recorded from the beginning of a line, recording is effected in accordance with the velocity mode VVA, and when the sentence is to be recorded fully on a line, recording is effected in accordance with the velocity mode VVB. The time difference between the two is small as shown and thus, very high-speed recording as compared with the prior art can be accomplished.

Figure 3:
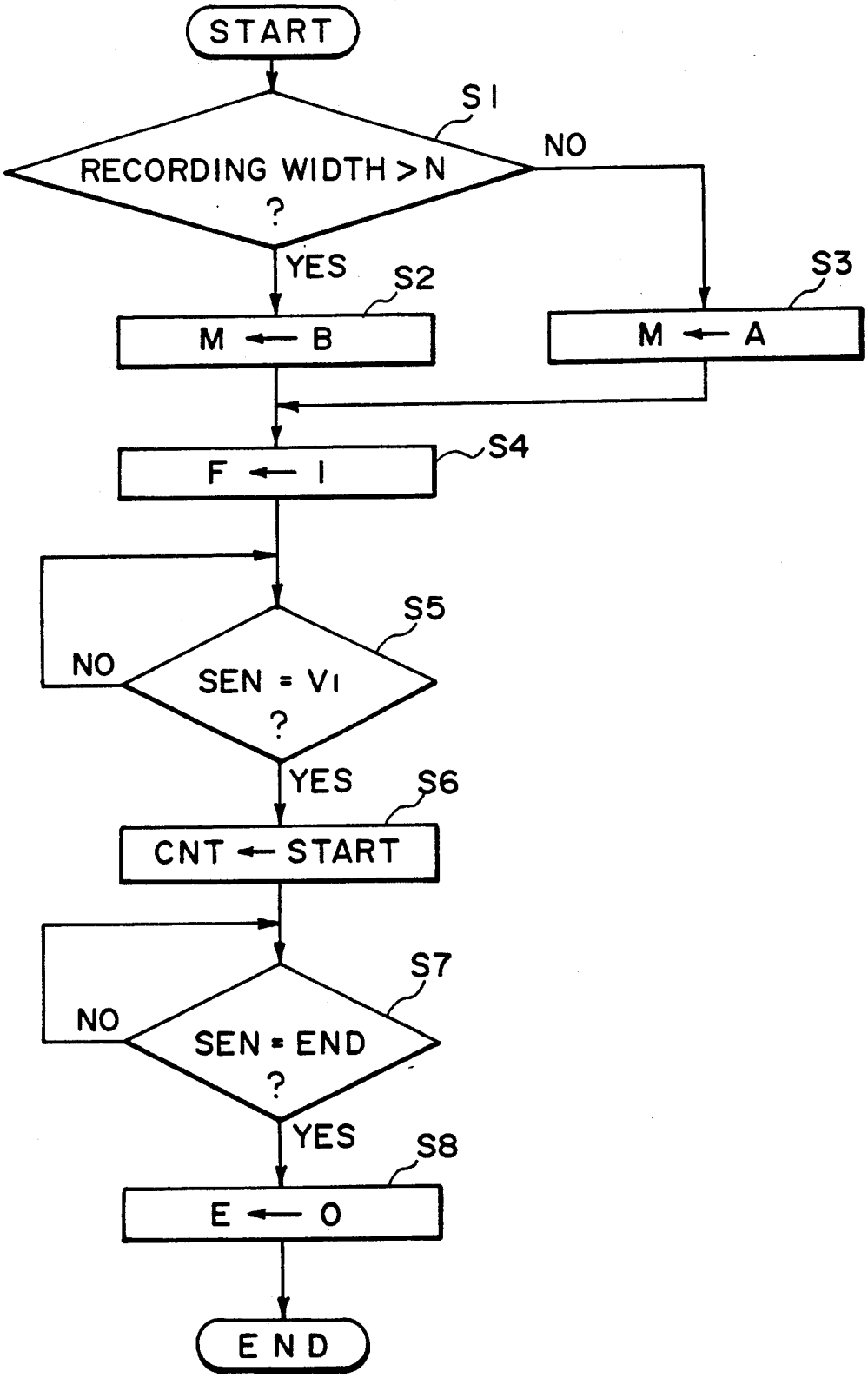
FIG. 3 is a flow chart of the recording control program in said embodiment.

FIG. 3 is a flow chart of the recording control program of the aforedescribed embodiment. In advance, the CPU 10 accesses the CG 13 by the character code in the RAM 12, and develops the read-out character pattern data into the IM 15. When the development of one record line is thus terminated, a development termination address (corresponding to the recording width) is set to the THC 23 through a control line CNT, and is input to the control of FIG. 3.

At a step S1, whether (the recording width)>N is discriminated. The recording width is already known from the developing process. The predetermined number N is, for example, about ½ of the width of paper (the effective width of recording paper) in the simplest case. Or the number N is the width over which recording can be effected in the section of ($PTB_1+PTB_3$) shown in FIG. 2. Accordingly, when for example, full recording is to be effected over the width of the paper, or when the first half of one line is blank but characters are present in the latter half, or when characters or words are scattered over the width of the paper, (the recording width)>N is satisfied. When characters are present in only the first half of one line, (the recording width)>N is not satisfied. If at the step S1, (the recording width)>N , at a step S2, "B" (the mode VVB) is set in the recording mode M. If at the step S1, not (the recording width)>N, at step S3, "A" (the mode VVA) is set in the recording mode M. At a step S4, the energization signal E of the VG 17 is set to logic 1 level. Thereby the carrier 1 starts its acceleration. At a step S5, (the carrier velocity =V1) is waited for through the sense line (SEN) of the THC 23. Since a signal TTA/B associated with a velocity signal VVA/B is input to the THC 23, the velocity $V_1$ can be detected from the period of this signal. Of course, the velocity $V_1$ may be detected by other methods. When carrier velocity=$V_1$ is reached, advance is made to a step S6, where the read-out recording control in the THC 23 is energized (CNT←start). As a result the THC reads out pattern data in succession from the first address of the IM 15 and drives the thermal head 4 for heat generation in synchronism with a pulse signal TTA/B. At a step S7, the end of recording (SEN=END) is waited for through the sense line SEN. That is, when the read-out address (AD) in the THC 23 becomes a preset development end address (recording width), recording is terminated. At a step S8, the energization signal E of the VG 17 is set to logic 0 level.

Even if at the step S8, the energization signal E of the VG 17 is not set to logic 0 level, there will be no problem, because in any case, at the terminal and of the paper width, the carrier stops without fail in accordance with the velocity sequence VVB (or VVA) of FIG. 2. On the other hand, setting the energization signal E to logic 0 level has the following advantage. For example, the velocity sequence VVA of FIG. 2 can start deceleration at any point of time whereat recording is terminated, whereby the efficiency of the carrier demand scanning is improved. Also, in the case of the velocity sequence VVB, deceleration can be started as indicated by a line Q at any point of time whereat recording is terminated.

Accordingly, moving means for moving the recording unit of the present embodiment in accordance with a predetermined velocity sequence not only refers to a construction comprising the VG 17, etc. of FIG. 1, but also includes means for realizing the function of detecting the velocity $V_1$ and then recording at this constant velocity $V_1$, or the function of detecting the velocity $V_1$ and then recording up to the velocity $V_2$ and continuing to record at this constant velocity $V_2$.

Figure 5:
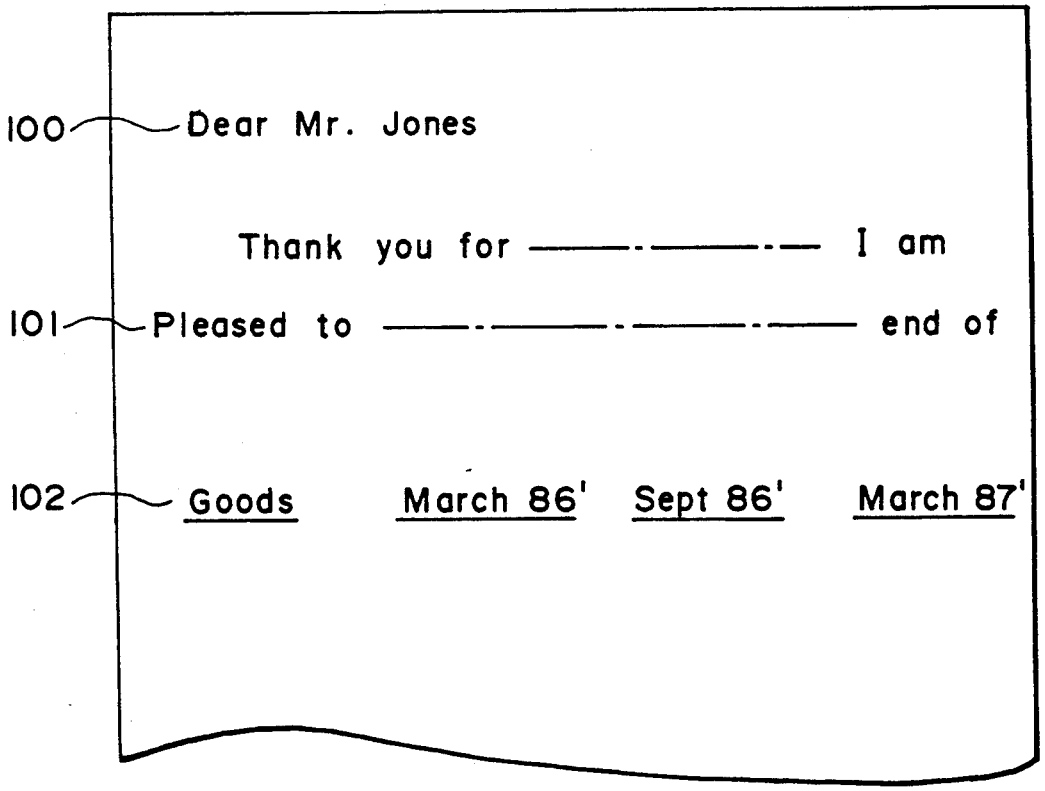
FIG. 5 shows an example of the recording by the embodiment.

FIG. 5 shows an example of the recording by the aforedescribed embodiment. In FIG. 5, the reference numeral 100 designates a line which does not satisfy (the recording width) >N. In this case, recording is effected in the graph VVA mode of FIG. 2. Lines 101 and 102 are lines which satisfy (the recording width)>N. In these cases, recording is effected in the graph VVB mode of FIG. 2.

Where as in the line 102, a relatively large blank portion is present in the course of the recorded line, the thermal head 4 may be once floated from the recording paper 2 for saving of the recording ribbon 5 and the ribbon may not be fed in that section (so-called skip function).

Also, the carrier motor may be any of pulse motor, a DC motor, etc., and as regards the timing for applying heat, in the case of a pulse motor, heat may be applied in synchronism with the change-over timing of the excitation phase, and in the case of a DC motor, heat may be applied in synchronism with the signal timing of an encoder or the like, whereby record at a predetermined pitch (or ordinary natural images) may be obtained irrespective of acceleration, constant velocity or deceleration. For example, assuming that one step of the carrier motor corresponds to (1/360) inch/pitch on the paper and the dot pitch of an image is in also (1/360) inch/pitch, the heat dot is renewed in conformity with the angle of rotation of the pulse motor or the DC motor even during acceleration or deceleration as well as during constant velocity movement and therefore, images of a predetermined pitch are always obtained. As the heat pulse width, use is made, for example, a heat pulse width which satisfies the velocity $V_2$ so that uniform density may be obtained in the entire recording section.

Also, originally, recording is possible even in the non recording section, i.e., immediately after the start of the movement of the carrier 1, or immediately before the stoppage of the carrier 1, but actually, due to the presence of the inertia, flexure, back-lash, etc. of the mechanism portion, recording in this section becomes unstable and therefore, recording in this section has not been adopted in the present embodiment.

Also, while in the above-described embodiment, the velocity modes are two, i.e., $V_1$ and $V_2$, this is not restrictive, but $V_3$, $V_4$, . . . may further be added to thereby provide multiple velocity modes. It is also possible to set the change-over set values $N_2$, $N_3$, . . . of the recording width finely in conformity with them.

Also, in the above-described embodiment, design is made such that in the graph VVB mode of FIG. 2 wherein printing is effected at the velocity $V_2$, recording is executed in both of a section PTB1 in the acceleration area and a section PTB 3 in the deceleration area, but design may also be made such that these sections are not recorded and recording is executed only in an area PTB2. Again in this case, the change-over set value N of the recording width may be suitably determined and the recording speed may be automatically changed over to $V_1$ and $V_2$ by N and recording may be effected, whereby a higher speed of recording can be realized.

Figure 6:
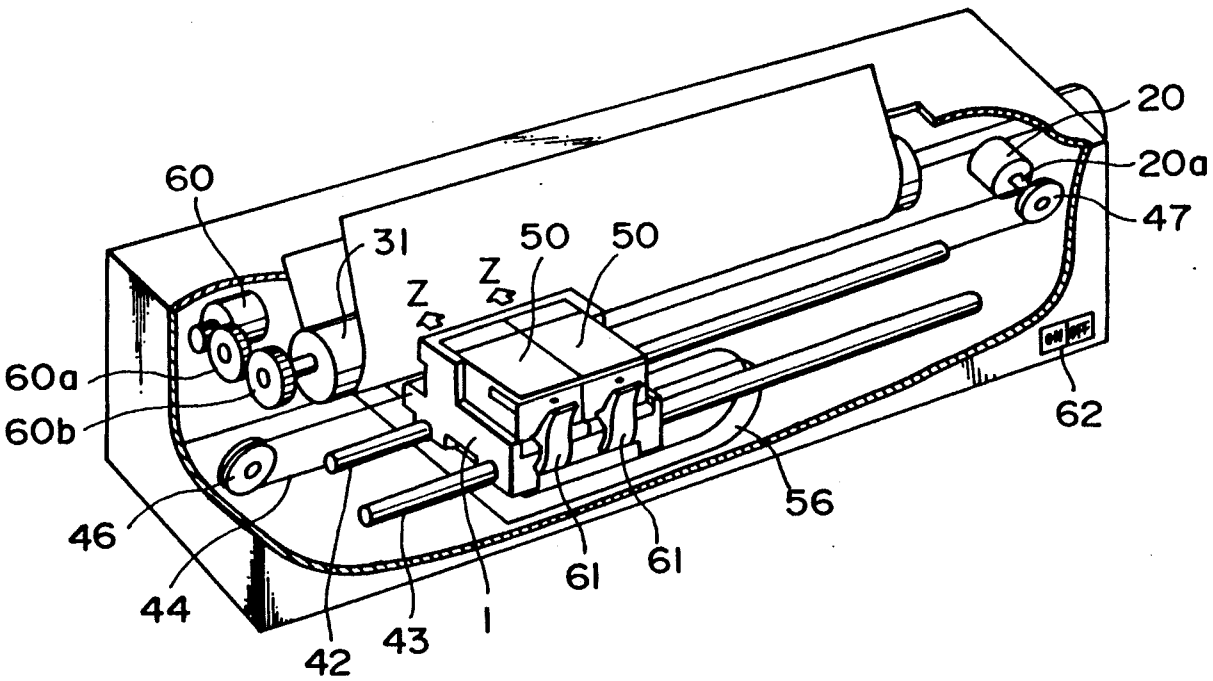
FIG. 6 is a perspective view of an ink jet recording apparatus as a recording apparatus to which an embodiment of the present invention is applied.

Another embodiment will now be described with reference to FIG. 6. FIG. 6 is a perspective view showing an embodiment of the ink jet recording apparatus to which the present invention is applied as in the aforedescribed embodiment. In FIG. 6, members functionally similar to those in the aforedescribed embodiment are given similar reference numerals and need not be described.

In FIG. 6, the reference numeral 50 designates a head cartridge in which a recording head constructed by the use of a heater board and an ink tank which is an ink supply source are made as a unit. This head cartridge 50 is removably fixed onto the carrier 1 by a keep member 61, and these are reciprocally movable in the lengthwise direction along shafts 42 and 43. Ink discharged from the discharge openings of the recording head reaches the recording paper 2 disposed with a minute spacing with respect to the recording head and having the recording surface thereof controlled by a platen 31, and records images on the recording paper 2.

A discharge signal conforming to image data is supplied from a suitable data supply source to the recording head through a cable 56 and a terminal (not shown) coupled thereto. One or a plurality of (in the figure, two) head cartridge 50 can be provided in conformity with the ink colors used. The recording head has an electro-thermal converting member, and film boiling is caused by the heat generation of the electro-thermal converting member to thereby form a bubble in the ink, and by the growth and contraction of this bubble, the ink is discharged from the discharge openings. The reference numeral 60 denotes a feed motor for rotating the platen roller 31 through gears 60*a* and 60*b*. The reference numeral 62 designates a switch for closing and opening the power source of the ink jet recording apparatus.

The aforedescribed embodiment brings about an excellent effect in a recording apparatus to which particularly the bubble jet recording system among the ink jet recording systems is applied.

As regards the typical construction and principle of it, a system is preferable which uses the basic principle disclosed, for example, in U.S. Pat. No. 723,129 and U.S. Pat. No. 4,740,796. This system is applicable to both of the so-called on-demand type and the so called continuous type, and is particularly effective in the case of the on-demand type because at least one driving signal corresponding to recording information and providing a rapid temperature rise exceeding nuclear boiling is applied to an electro-thermal converting member disposed correspondingly to a sheet or a liquid path in which liquid (ink) is retained whereby heat energy is generated in the electro-thermal converting member and film boiling is caused on the heat-acting surface of the recording head with a result that a bubble in the liquid (ink) can be formed in one-to-one correspondence to the driving signal. By the growth and contraction of this bubble, the liquid (ink) is discharged through a discharge opening to form at least one droplet. If this driving signal is made into a pulse-like shape, the growth and contraction of the bubble take place appropriately on the spot and therefore, the discharge of liquid (ink) particularly excellent in responsiveness can be accomplished, and this is preferable. As this driving signal of the pulse-like shape, those as described in U.S. Pat. No. 4,463,359 and U.S. Pat. No. 4,345,262 are suitable. If the conditions described in U.S. Pat. No. 4,313,124 which discloses an invention relating to the temperature rise rate of said heat-acting surface are adopted, more excellent recording can be accomplished.

As regards the construction of the recording head, besides a construction comprising a combination of discharge openings, liquid paths and electro-thermal converting members as disclosed in the aforementioned patents (a straight liquid flow path or a right-angled liquid flow path), a construction using U.S. Pat. No. 4,558,333 and U.S. Pat. No. 4,459,600 which disclose a construction in which the heat-acting portion is disposed in a bent area is also applicable to the aforedescribed embodiment. In addition, the aforedescribed embodiment is also effective if made into a construction based on Japanese Laid-Open Patent Application No. 59-123670 which discloses a construction in which a slit common to a plurality of electro thermal converting members provides the discharge portion of the electro-thermal converting members or Japanese Laid-Open Patent Application No. 59-138461 which discloses a construction in which an opening for absorbing the pressure wave of heat energy corresponds to the discharge portion.

In addition, the aforedescribed embodiment is also effective where use is made of an interchangeable chip type recording head in which, by being mounted on an apparatus body, the electrical connection to the apparatus body and supply of ink from the apparatus body become possible, or a cartridge type recording head in which a cartridge is integrally provided in a recording head itself.

Also, the addition of recovery means, preliminary auxiliary means, etc. for the recording head to the construction of the recording apparatus of the aforedescribed embodiment can stabilize the effect of the aforedescribed embodiment and is therefore preferable. Specifically mentioning these, they are capping means, cleaning means and pressurization or suction means for the recording head and preheating means comprising an electro-thermal converting member or a heating element discrete therefrom or a combination thereof, and it is also effective for accomplishing stable recording to carry out a preliminary discharge mode in which discharge discrete from recording is effected.

Further, the recording mode of the recording apparatus is not limited to the recording mode of only the main current such as black, but the aforedescribed embodiment is also very effective for an apparatus provided with at least one of a plurality of different colors and full color by a color mixture although it may depend on whether the recording head is constructed as a unit or formed by a combination of a plurality of heads.

In the above-described embodiments of the ink jet recording apparatus, the ink is described as liquid, but alternatively the ink may be ink which solidifies, for example, at room temperature or below and softens or liquefies at a temperature higher than room temperature. In the aforedescribed ink jet, it is usual to regulate the temperature of the ink itself within a range higher than 30° C. and lower than 70° C. and control the temperature so that the viscosity of the ink may be within a stable discharge range and therefore, use may be made of ink which liquefies when a recording signal is imparted. In addition, heat energy is used as the energy for the phase change of the ink from its solid state to its liquid state to thereby prevent the temperature rise caused by the heat energy, or ink which solidifies while it is left as it is is used for the purpose of preventing the evaporation of the ink, and in any case, the use of ink having the nature of being liquefied only by heat energy, such as ink which liquefies by heat energy imparted in conformity with a recording signal and is discharged in the form of liquid or ink which already begins to solidify at a point of time whereat it reaches a recording medium is also applicable to the present embodiment. In such a case, the ink may be in a form in which it is opposed to the electro-thermal converting member while being retained as a liquid or a solid in the recesses or the through-holes of a porous sheet as described in Japanese Laid-open Patent Application No. 54-56847 or Japanese Laid-open Patent Application No. 60-71260. In the aforedescribed embodiment, what is most effective for each of the above-described inks is that which executes the above-described film boiling system.

In the present invention, the recording means is not limited to the aforedescribed bubble jet recording system and the so-called heat transfer recording system in which an ink sheet having meltable ink applied thereto is heated in conformity with an image signal and the melted ink is transferred to a recording sheet, but can adopt other various recording systems such as the so-called thermosensitive recording system in which for example, a recording sheet forming a color by heat is heated in conformity with an image signal, and the so-called wire dot recording system in which an ink ribbon is tapped by a wire in conformity with an image signal to thereby accomplish recording. Accordingly, the recording head is neither limited to the aforedescribed bubble jet head, the thermal head or the like, but may be, for example, a wire dot head or the like.

As described above, according to the present embodiment, there can be provided a recording method capable of accomplishing high-speed recording and a recording apparatus using such recording method.

I claim:

1. A recording method of effecting recording on a recording medium, comprising the steps of:

recognizing a recording width over which recording is to be effected; and effecting recording on a recording medium at a movement velocity selected in conformity with the recognized recording width by first accelerating recording means along the conveyance path of a recording medium, then moving the recording means along the conveyance path with constant velocity and then decelerating the recording means, and by effecting recording when the recording means moves at a constant velocity and when the recording means is accelerating or decelerating and in accordance with the timing of signals responsive to the movement velocity when the recording means is accelerated, decelerated and moved at a constant velocity.

2. A recording method of effecting recording on a recording medium, comprising the steps of:

accelerating recording means on the recording medium along a conveyance path of the recording medium and thereafter moving the recording means at a constant velocity and thereafter decelerating the recording means;

recognizing a recording width over which recording is to be effected and selecting a uniform movement velocity in conformity with the recognized recording width; and effecting recording when the recording means moves at a constant velocity and when the recording means is accelerating or decelerating in accordance with the timing of signals responsive to the velocity of the recording means when the recording means accelerates, decelerates and moves at a constant velocity.

3. A recording method according to claim 1 or 2, further comprising the step of applying a pulse to a head of the recording means generated in conformity with the movement velocity to thereby generate heat.

4. A recording method according to claim 1 or 2, wherein said recognizing step for recognizing the recording width is performed for each line on which recording is to be effected.

5. A recording method according to claim 1 or 2, further comprising the steps of driving a thermal head of the recording means for heat generation in conformity with recording in formation and transferring ink of an ink ribbon to the recording medium to thereby accomplish recording.

6. A recording method according to claim 1 or 2, further comprising the step of discharging ink from a discharge opening of an ink jet head of the recording means in conformity with recording information to thereby effect recording on the recording medium.

7. A recording method according to claim 1 or 2, further comprising the steps of discharging ink from an ink jet head of the recording means utilizing heat energy to discharge the ink and generating the heat energy with an electro-thermal converting member of the recording means.

8. A recording method according to claim 1 or 2, wherein the recording means is held on a carrier, said method further comprising the step of reciprocally moving by belt driving the recording means.

9. A recording apparatus for effecting recording on a recording medium, comprising:

recording means for effecting recording on the recording medium;

driving means for moving said recording means along a conveyance path of the recording medium;

selecting means for selecting a movement velocity of said recording means by said driving means;

recognizing means for recognizing a recording width over which recording is to be effected; and control means for controlling said driving means to first accelerate said recording means, to then move said recording means at a constant velocity selected in conformity with the recording width recognized by said recognizing means, and to then decelerate said recording means, wherein said control means controls said recording means to effect recording when moving at a constant velocity and when said recording means is accelerating or decelerating in accordance with the timing of signals responsive to the movement velocity of said recording means when said recording means is accelerating, decelerating, and moving at a constant velocity.

10. A recording apparatus for effecting recording on a recording medium, comprising:

recording means for effecting recording on the recording medium;

conveying means for conveying the recording medium; and means for recognizing a recording width over which recording is to be effected, means for first accelerating said recording means along a conveyance path of the recording medium, next moving said recording means along the conveyance path at a constant velocity selected in conformity with the recognized recording width, and then decelerating said recording medium and means for controlling said recording means to effect recording when said recording means moves at the constant velocity and when said recording means accelerates or decelerates in accordance with the timing of signals responsive to the velocity of said recording means when said recording means is accelerating, decelerating, and moving at a constant velocity.

11. A recording apparatus according to claim 9 or 10, wherein said recording means has a head to which a pulse generated in conformity with the movement velocity is applied to thereby generated heat.

12. A recording apparatus according to claim 9 or 10, wherein the recognition of the recording width is done for each line on which recording is to be effected.

13. A recording apparatus according to claim 9, or 10, wherein said recording means has a thermal head which is driven for heat generation in conformity with recording information and transfers ink of an ink ribbon to the recording medium to thereby accomplish recording.

14. A recording apparatus according to claim 9 or 10, wherein said recording means has an ink jet head which discharges ink from a discharge opening in conformity with recording information to thereby effect recording on the recording medium.

15. A recording apparatus according to claim 9 or 10, wherein said recording means has an ink jet head which utilizes heat energy to discharge ink and which is provided with an electro-thermal converting member for generating the heat energy.

16. A recording apparatus according to claim 9 or 10, wherein said recording means is held on a carrier reciprocally movable by belt driving.

17. A recording apparatus according to claim 9 or 10, wherein said control means has a CPU, an RAM and a ROM.

18. A recording apparatus for moving a recording unit relative to a recording surface and effecting recording, comprising:

moving means for moving the recording unit in accordance with a predetermined velocity sequence comprising first accelerating the recording unit, next moving the recording unit at a constant velocity, and then decelerating the recording unit;

means for recognizing a recording width over which recording is to be effected, and recording means for effecting recording when the recording unit moves at the constant velocity selected in conformity with the recording width and when the recording unit accelerates or decelerates in accordance with the timing of signals responsive to the velocity of said recording means when said recording means in accelerating, decelerating, and moving at a constant velocity.

19. A recording apparatus according to claim 18, wherein said velocity sequence differs depending on the recording width of a line to be recording.

20. A recording apparatus according to claim 18, wherein the gradient of the acceleration and deceleration of said velocity sequence is equal.

21. A recording apparatus for effecting recording on a recording medium, comprising:

recording means, adapted to accelerate, decelerate, and move at a constant velocity, for effecting recording on the recording medium;

conveying means for conveying the recording medium; and means for recognizing a recording width over which recording is to be effected, means for accelerating, decelerating, and moving said recording means at a constant velocity, means for changing the maximum value of the velocity of the movement of said recording means along a conveyance path, means for effecting the recording by said recording means in conformity with the recognized recording width, when said recording means moves at a constant velocity and means for effecting recording with said recording means when said recording means moves at a constant velocity, accelerates or decelerates in accordance with the timing of signals responsive to the velocity of said recording means when said recording means is accelerating, decelerating, and moving at a constant velocity.

22. A recording apparatus for effecting recording on a recording medium, comprising:

recording means for effecting recording on the recording medium;

conveying means for conveying the recording medium; and control means for recognizing a recording width over which recording is to be effected, means for controlling said recording means so as to operate for a time in conformity with said recognized recording width, said means controlling said recording means to accelerate, decelerate, and move at a constant velocity and means for effecting recording when moving at a constant velocity and when accelerating or decelerating in accordance with the timing of signals responsive to the velocity of said recording means when said recording means is accelerating, decelerating, and moving at a constant velocity.

23. A recording apparatus according to claim 21 or 22, wherein said recording means has a thermal head which is driven for heat generation in conformity with recording information and transfers ink of an ink ribbon to the recording medium to thereby accomplish recording.

24. A recording apparatus according to claim 21 22, wherein said recording means has an ink jet head which discharges ink from a discharge opening in conformity with recording information to thereby effect recording on the recording medium.

25. A recording apparatus according to claim 21 or 22, wherein said recording means has an ink jet head which utilizes heat energy to discharge ink and which is provided with an electro-thermal converting member for generating the heat energy.

26. A recording apparatus according to claim 21 or 22, wherein a length of a non-recording section in which recording during the movement of said recording means is not effected is constant irrespective of the highest& velocity during recording.

* * * * *

UNITED STATES PATENT AND TRADEMARK OFFICE

CERTIFICATE OF CORRECTION

PATENT NO. : 5,189,436

DATED : February 23, 1993

INVENTOR(S) : JUNICHI YOSHIKAWA

It is certified that error appears in the above-indentified patent and that said Letters Patent is hereby corrected as shown below:

On the title page: Item

[30] Foreign Application Priority Data

Insert: --Mar. 15, 1990 [JP] Japan .....2-62690--.

[56] References Cited

OTHER PUBLICATIONS: "Office" (all three occurrences) should read --Office,--.

COLUMN 1

Line 24, "systems" should read --system--.

COLUMN 2

Line 7, "block diagram of the control unit of a" should be deleted.

COLUMN 3

Line 27, "in" should be deleted.

Line 35, "in paral-" should read --parallel--.

Line 36, "lelism" should be deleted.

COLUMN 4

Line 40, "$l_2$" should read --$l_2$.--.

COLUMN 5

Line 4, "results" should read --result,--.

Line 5, "more improved, greatly" should read --improved greatly,--

Line 54, "←s-" should read --←- --.

Line 55, "tart)." should read --start).--.

Line 67, "and" should read --end--.

UNITED STATES PATENT AND TRADEMARK OFFICE

CERTIFICATE OF CORRECTION

PATENT NO. : 5,189,436 Page 2 of 2

DATED : February 23, 1993

INVENTOR(S) : JUNICHI YOSHIKAWA

It is certified that error appears in the above-indentified patent and that said Letters Patent is hereby corrected as shown below:

COLUMN 7

Line 55, "No. 723,129" should read --No. 4,723,129--.

COLUMN 12

Line 55, "21 22" should read --21 or 22--.

Line 69, "highest&" should read --highest--.

Signed and Sealed this

Twenty-second Day of March, 1994

Bruce Lehman

*Attest:*

BRUCE LEHMAN

*Attesting Officer*

*Commissioner of Patents and Trademarks*